US008643298B2

(12) United States Patent
Palazzolo et al.

(10) Patent No.: US 8,643,298 B2
(45) Date of Patent: Feb. 4, 2014

(54) ILLUMINATION DEVICE INCLUDING LEDS AND A SWITCHING POWER CONTROL SYSTEM

(71) Applicant: iLumisys, Inc., Troy, MI (US)

(72) Inventors: Francis Palazzolo, Rochester, MI (US); John Ivey, Farmington Hills, MI (US)

(73) Assignee: iLumisys, Inc., Troy, MI (US)

( * ) Notice: Subject to any disclaimer, the term of this patent is extended or adjusted under 35 U.S.C. 154(b) by 0 days.

(21) Appl. No.: 13/860,694

(22) Filed: Apr. 11, 2013

(65) Prior Publication Data

US 2013/0229122 A1 Sep. 5, 2013

Related U.S. Application Data

(62) Division of application No. 12/821,769, filed on Jun. 23, 2010, now Pat. No. 8,421,366.

(60) Provisional application No. 61/219,627, filed on Jun. 23, 2009.

(51) Int. Cl.
*H05B 37/02* (2006.01)

(52) U.S. Cl.
USPC ..... 315/224; 315/291; 315/307

(58) Field of Classification Search
USPC ..... 315/307, 308, 291, 224, 209 R, 227 R, 315/240, 241 R, 242, 246
See application file for complete search history.

(56) References Cited

U.S. PATENT DOCUMENTS

| | | | | |
|---|---|---|---|---|
| 7,274,183 | B1 | 9/2007 | Gu et al. | |
| 7,466,082 | B1 | 12/2008 | Snyder et al. | |
| 7,649,327 | B2 * | 1/2010 | Peng | 315/312 |
| 2010/0237790 | A1 * | 9/2010 | Peng | 315/210 |

* cited by examiner

*Primary Examiner* — David H Vu
(74) *Attorney, Agent, or Firm* — Young Basile

(57) ABSTRACT

Disclosed herein is an illumination device having at least one LED and a power converter with a switching element for connection to an existing fluorescent lamp fixture including a conventional ballast. The illumination device includes a feedback circuit operable to provide a switching signal to the switching element according to a duty cycle, the feedback circuit configured to: increase the value of the duty cycle to decrease an output current signal through the at least one LED; and decrease the value of the duty cycle to increase the output current signal through the at least one LED.

20 Claims, 7 Drawing Sheets

ILLUMINATION DEVICE INCLUDING LEDS AND A SWITCHING POWER CONTROL SYSTEM

CROSS-REFERENCE TO RELATED APPLICATIONS

This application is a divisional of U.S. patent application Ser. No. 12/821,769, filed Jun. 23, 2010, now U.S. Pat. No. 8,421,366 which claims priority to Provisional Application Ser. No. 61/219,627, filed Jun. 23, 2009, both of which are hereby incorporated by reference in their entireties.

TECHNICAL FIELD

The present invention relates in general to conversion of an alternating current (AC) to direct current (DC), and more specifically, to an illumination device including light-emitting diodes and a switching power control system.

BACKGROUND

Incandescent light bulbs are gradually being replaced by light-emitting diodes (LEDs) in many applications. LEDs have many advantages over traditional incandescent lamps in that they have longer operational life, reduced power consumption, greater durability and increased design flexibility.

Despite these advantages, at present LEDs are not used in all applications. LEDs commonly operate on a supply of DC. Accordingly, many applications that use LEDs require conversion of an AC power supply to a DC power supply. For example, U.S. Pat. No. 7,049,761 assigned to the assignee of this invention, discloses a power supply circuit that includes a rectifier circuit and a PWM switching circuit. The rectifier converts AC power to DC power and the PWM switching circuit receives the DC power and pulse-width modulates the DC power to supply an LED array. Known converters are not practical for use with some LED applications because of their size and excessive cost. Passive components such as capacitors and inductors within known converters become larger as operating voltages increase thereby increasing the overall size and cost of the LED device.

SUMMARY

Embodiments of an illumination device having at least one LED and a power converter with a switching element for connection to an existing fluorescent lamp fixture including a conventional ballast are disclosed herein. In one embodiment, the illumination device includes a feedback circuit operable to provide a switching signal to the switching element according to a duty cycle. The feedback circuit is configured to increase the value of the duty cycle to decrease an output current signal through the at least one LED and to decrease the value of the duty cycle to increase the output current signal through the at least one LED.

Embodiments of a method of controlling a feedback circuit for an illumination device having at least one LED and a power converter with a switching element are also disclosed herein. In one embodiment, the method includes providing a switching signal to the switching element according to a duty cycle, and at least one of: increasing the value of the duty cycle to decrease an output current signal through the at least one LED or decreasing the value of the duty cycle to increase the output current signal through the at least one LED.

These and other embodiments are described in additional detail hereinafter.

BRIEF DESCRIPTION OF THE DRAWING

The various features, advantages and other uses of the present invention will become more apparent by referring to the following detailed description and drawing in which.

DETAILED DESCRIPTION

Embodiments of the invention power a LED lighting fixture through an existing ballast designed to power a fluorescent bulb using a novel circuit topology and control system requiring only a single active switch. Power dissipation and component count are minimized, and advanced controls, such as dimming, are possible. Such embodiments are best explained by reference to FIGS. 1A-13.

To control power in a set of light-emitting diodes (LEDs), as described herein it is desirable to control the total current through them. Since the voltage $V_{led}$ across the LEDs is substantially constant when the LEDs are on, a desired power level $P_{led}$ supplied to the LEDs conforms to the following equation:

$$P_{led}=V_{led}*I_{led}; \text{ wherein} \quad (1)$$

$I_{led}$ is the total current through the LEDs.

Figure 1A:
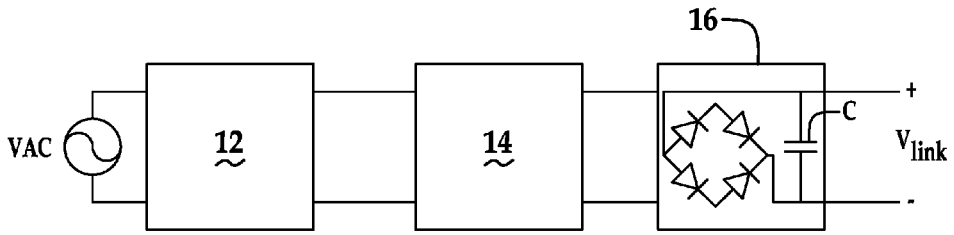
FIG. 1A is a block diagram of a power supply provided by a basic ballast with a rectifier circuit.
Figure 1B:
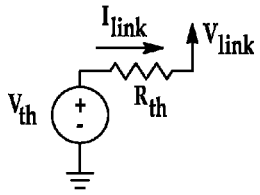
FIG. 1B is a Thevenin equivalent circuit of FIG. 1A.

As shown in FIG. 1A, a power supply includes a ballast 12 receiving an AC input 10 from a conventional source such as a 110 VAC outlet. Ballast 12 is a conventional ballast that supplies a fluorescent bulb. The output of ballast 12 is generally a higher voltage AC source, which is rectified to a DC link voltage by a full-wave rectifier 16, shown in the form of a diode bridge by example. Between ballast 12 and rectifier 16 is protection 14 in the form of, for example, diodes, etc., to protect components of rectifier 16 and the LEDs of the load from voltage spikes.

As a steady-state approximation, fluorescent ballast 12 and rectifier 16 act as a Thevenin equivalent power source as shown in FIG. 1A and as described in the following equation:

$$V_{link}=V_{th}-I_{link}*R_{th}; \text{ wherein} \quad (2)$$

$V_{link}$ is the rectified DC link voltage;

$V_{th}$ is the Thevenin equivalent voltage for ballast 12 and rectifier 16;

$I_{link}$ is the current drawn from the DC supply; and $R_{th}$ is the Thevenin equivalent resistance for ballast 12 and rectifier 16. The Thevenin equivalent values $V_{th}$ and $R_{th}$ are modeled as constant for any given ballast. Such values can be obtained through, for example, testing.

As seen from equation (2), the DC link voltage $V_{link}$ decreases in a linear fashion as $I_{link}$ increases.

Figure 2:
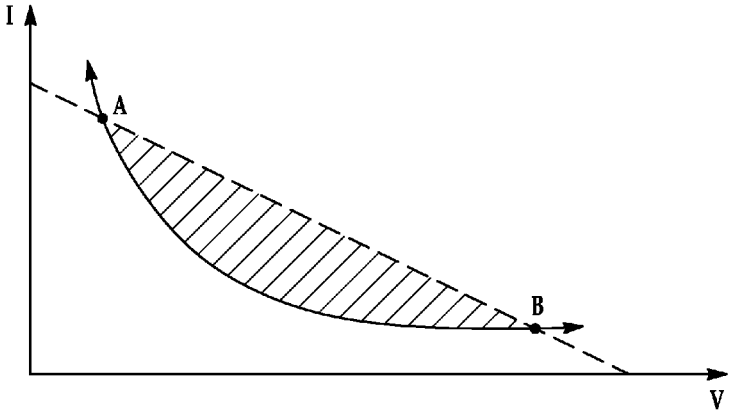
FIG. 2 is a load-line plot of FIG. 1A.

This can be seen graphically in FIG. 2, where it is assumed that the DC output of the Thevenin equivalent circuit is used to directly drive the LEDs. More specifically, the graph of FIG. 2 plots both equation (1) and equation (2) in terms of current (I) versus voltage (V). The load curve, that is, that corresponding to equation (1), is shown as a solid line. Conversely, the source curve, which corresponds to equation (2), is shown as a dashed line.

There are two points where the load and source curves crossover, point A and point B. Point A corresponds to a low-voltage, high-current supply, while point B corresponds to a high-voltage, low-current supply. The shaded area between the curves and points A and B represents ballast current exceeding the need of the LEDs, that is, where power supplied by the link $P_{link}$ (which is equal to $V_{link}*I_{link}$) is greater than $P_{led}$. Point A is conventionally considered an unstable operating point because increasing current to a power converter decreases the power draw to the LEDs. Point B is conventionally considered a stable operating point because increasing current to the power converter increases the power draw to the LEDs.

Even though point A is an unstable operating point, it desirable to operate at this point as described herein because, among other advantages, smaller and less expensive components can be used for control of the DC output.

Figure 3:
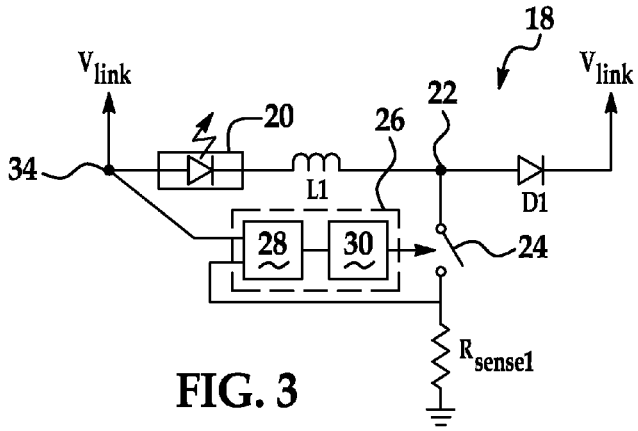
FIG. 3 is one embodiment of a circuit topology and feedback control system taught herein.

FIG. 3 illustrates the topology of one circuit 18 that can operate at this low-voltage, high-current operating point in a stable manner. The embodiment includes a low-side switch 24. More specifically, circuit 18 applies the DC link voltage $V_{link}$ across at least one LED, represented by LED 20, connected in series with an inductor L1 and a diode D1. While LED 20 is described as connected in series with the inductor L1 and diode D1, the LEDs that comprise LED 20 are not necessarily themselves connected in series to one another. That is, LED 20 can represent a plurality of LEDs connected in parallel and/or in series with respect to each other. LED 20 could, for example, be in the form of an array. LED 20 can include surface-mounted or discrete LED components. In certain embodiments, it would be desirable if LED 20 were one or more organic LEDs. Although not specifically shown, relatively small resistors can be inserted between the LEDs in order to provide the correct current draw in the passive circuit design.

Inductor L1 provides discharging and charging current that, together with a capacitor C of DC rectifier 16, smooth the DC link voltage $V_{link}$. Diode D1 can prevent reverse currents from flowing through the circuit.

Connected from a tap 22 between inductor L1 and diode D1 to ground is low-side switch 24 and a sense resistor $R_{sense1}$. When switch 24 is closed, the current flowing across sense resistor $R_{sense1}$ is monitored. The current so measured is a peak current at the applied DC link voltage $V_{link}$. This peak current can be used to calculate (or estimate) the average current through LED 20. For example, the average current can be calculated from the peak current if the operating point and/or some component values of the circuitry are known. Alternatively or in addition to this technique, the average current through LED 20 can be measured via a high side sense resistor, voltage sensing, measuring the emitted light or other suitable technique.

The measured current is supplied to a feedback circuit 26 including a control system 28 for a pulse width modulator 30. Control system 28 also receives as input the DC link voltage $V_{link}$. In general, operation of feedback circuit 26 is based on assuming that increasing the duty cycle at switch 24 will decrease LED 20 power (or decrease current through LED 20) and that decreasing the duty cycle at switch 24 will increase LED 20 power (or increase current through LED 20) when the duty cycle exceeds a predetermined value. Basically, feedback circuit 26 adjusts the duty cycle based on, for example, the current through LED 20 and the voltage $V_{link}$. This logic can be used to (through feedback circuit 26) "invert" the sense of the feedback such that an increase in the current in LED 20 leads to an increase in the duty cycle and a decrease in the current in LED 20 leads to a decrease in the duty cycle.

Figure 4:
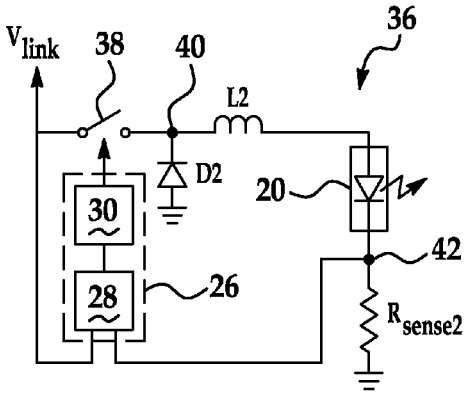
FIG. 4 is a second embodiment of the circuit topology and feedback control system taught herein.

FIG. 4 illustrates the topology of another circuit 36 that can stably operate at this low-voltage, high-current operating point. The embodiment includes a high-side switch 38 that selectively supplies the DC link voltage $V_{link}$ to LED 20 and inductor L2, which are connected in series to ground through sense resistor $R_{sense2}$. Diode D2 is connected to a tap 40 between high-side switch 38 and inductor L2 such that diode D2 is reverse-biased when high-side switch 38 is closed and is in parallel with LED 20.

Inductor L2 provides discharging and charging current that, together with capacitor C of DC rectifier 16, smooth the DC link voltage $V_{link}$. Diode D2 prevents reverse currents from flowing through the circuit.

The current across the sense resistor $R_{sense2}$ is read from a tap 42 between LED 20 and sense resistor $R_{sense2}$. Unlike circuit 18 of FIG. 3, current can be continuously monitored because the sensing in FIG. 4 is not tied to the ON-state of the switch 38. Accordingly, the average current through LED 20 is easily obtained in this embodiment.

The measured current is supplied to feedback circuit 26 described with reference to the first embodiment.

Figure 5:
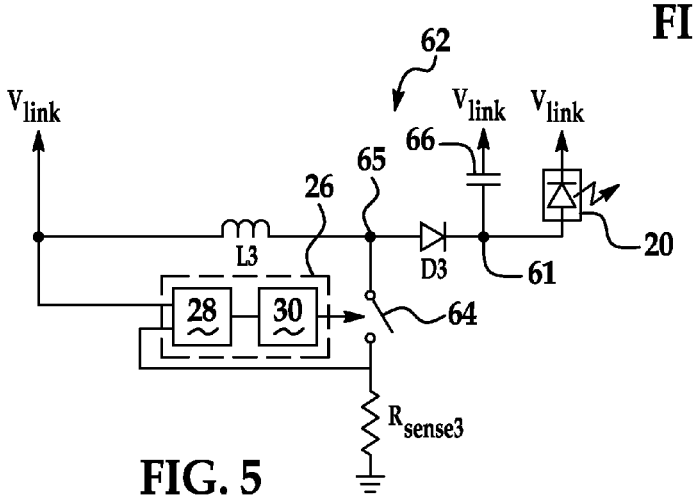
FIG. 5 is a third embodiment of the circuit topology and feedback control system taught herein.

FIG. 5 illustrates the topology of another circuit 62 that can stably operate at this low-voltage, high-current operating point. Similar to the embodiment of FIG. 2, this embodiment includes a low-side switch 64. More specifically, circuit 62 applies the DC link voltage $V_{link}$ through inductor L3. Connected from a tap 65 between inductor L3 and diode D3 to ground is low-side switch 64 and a sense resistor $R_{sense3}$. Diode D3 is connected between tap 65 and a tap 67. A capacitor 66 and LED 20 are connected in parallel and are connected between tap 67 and the DC link voltage $V_{link}$.

When the switch open, circuit 62 supplies current from the DC link voltage $V_{link}$ to inductor L3 via diode D3 and the capacitor 66 supplies current to the LED 20. When the switch is closed and when energy is stored into the inductor L3, the inductor L4 supplies current to LED 20.

When switch 64 is closed, the current flowing across sense resistor $R_{sense3}$ is monitored. Similar to the first embodiment, the average current can be calculated, for example from the peak current or by any other suitable technique. The measured current is supplied to feedback circuit 26 as is described with reference to the first embodiment.

Figure 6:
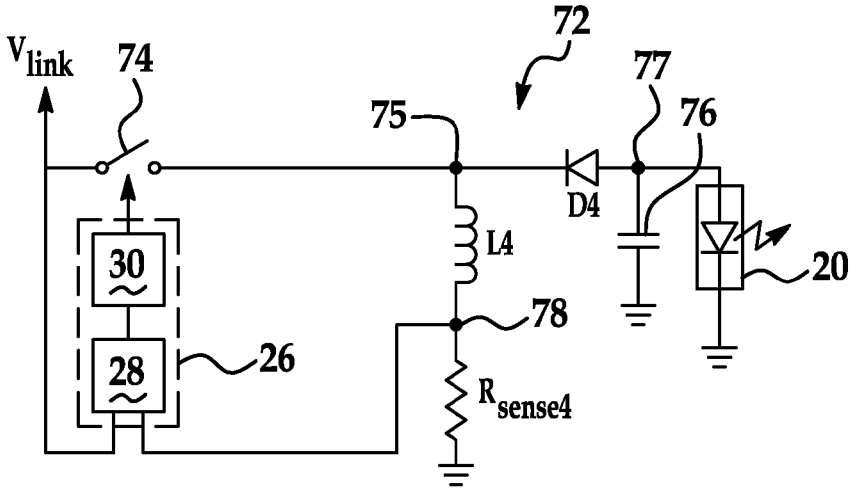
FIG. 6 is a fourth embodiment of the circuit topology and feedback control system taught herein.

FIG. 6 includes illustrates the topology of another circuit 72 that can stably operate at this low-voltage, high-current operating point. The embodiment includes a high-side switch 74 that selectively supplies the DC link voltage $V_{link}$ to LED 20 and inductor L4. Inductor L4 and a sense resistor $R_{sense4}$ are connected to ground from a tap 75 between high-side switch 74 and diode D4. Diode D4 is connected between tap 75 and a tap 77. A capacitor 76 is connected between tap 77 and ground and is in parallel with inductor L4 and $R_{sense4}$. LED 20 is also connected in parallel to capacitor 76 and is also in parallel with inductor L4 and $R_{sense4}$.

When the switch is in the ON-state, circuit 72 supplies current from the DC link voltage $V_{link}$ to inductor L4 and the capacitor 76 supplies current to the LED 20. When the switch is in the OFF-state and when energy is stored into the inductor L4, the inductor L4 supplies current to LED 20 via diode D4.

The current across the sense resistor $R_{sense4}$ is read from a tap 78 between inductor L4 and sense resistor $R_{sense4}$. Similar to the circuit of FIG. 4, current can be continuously monitored because the sensing in FIG. 6 is not tied to the ON-state of the switch 74. The measured current is supplied to feedback circuit 26 as is described with reference to the first embodiment.

Low-side switches 24 and 64 and high-side switches 38 and 74 can be any number of single switching elements. For example, a solid-state switch such as a field-effect transistor (FET), MOSFET, npn or pnp transistors, etc., can be used. Although only one switching element is shown, in each of FIGS. 3-6, each of the power converting circuits may have any suitable number of switches.

Further, the circuit topologies shown in FIGS. 3-6 are merely exemplary and other circuit structures having same or similar components may be utilized and implemented with a feedback circuit 26.

Assuming 100% efficient power conversion, the following relationships results:

$$P_{in}=P_{Out}=V_{link}*I_{link}=V_{led}*I_{led}; \text{ wherein} \tag{3}$$

$P_{in}$ is the power of the input into the power converter; and $P_{out}$ is the output power of the LED 20 (or $P_{led}$).

Figure 7:
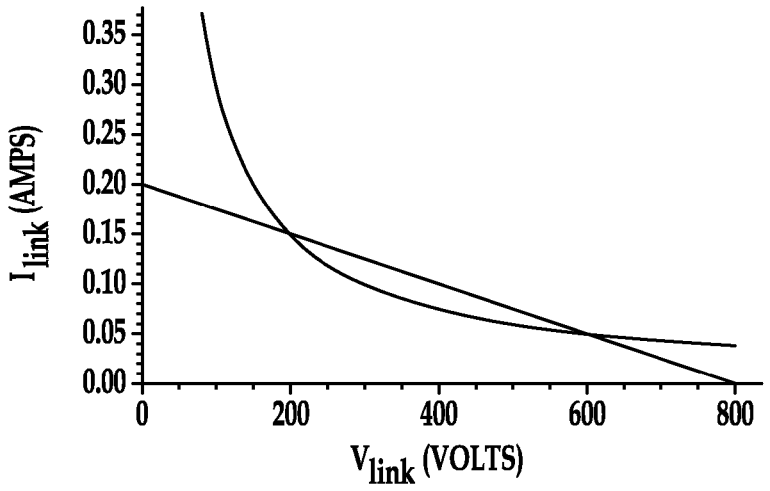
FIG. 7 is a load-line plot V/I using exemplary values for the ballast and load in a general case.
Figure 8:
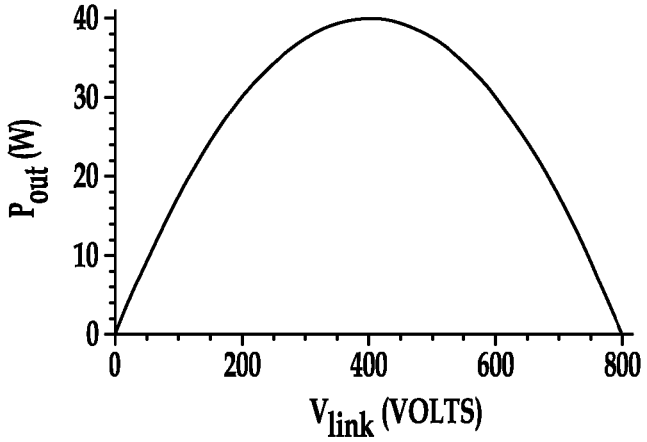
FIG. 8 is a plot of $P_{led}$ vs. $V_{link}$ in the general case.

FIG. 7 is a load-line plot of $I_{link}$ vs. $V_{link}$. As can be seen, these curves follow the theoretical curves shown in FIG. 2. The plot of FIG. 8 illustrates the parabolic relationship of $P_{out}$ vs. $V_{link}$ for the general case of FIG. 7. Although not illustrated, a plot of $P_{led}$ vs. $I_{led}$ and a plot of $I_{led}$ vs $I_{link}$ have the same parabolic relationships as illustrated in FIG. 8.

Combining equation (3) with the Thevenin equivalent source model represented by equation (2) gives a relationship between $I_{led}$ and $I_{link}$:

$$I_{led} = \frac{V_{th}}{V_{led}} I_{link} - \frac{R_{th}}{V_{led}} I_{link}^2 \tag{4}$$

The relationship set forth in equation (4) is valid, for example, for power converters having 100% efficient power conversion driven by the Thevenin equivalent source and driving a constant voltage load.

Further, for each value of $I_{link}$, the equation gives a unique value of $I_{led}$.

The maximum value of $I_{led}$ can be found using equation (4) and can be represented as follows:

$$I_{link(Iledmax)} = \frac{V_{th}}{2R_{th}} \tag{5}$$

The maximum value of $I_{led}$ is also the maximum power transfer point.

The power converters described above with reference to FIGS. 3-6, or any other suitable power converter, can operate in either discontinuous or continuous mode. The mode (discontinuous or continuous) can be determined by the duty cycle D, the period T, and the circuit element values of the power converter. For example, one circuit element value that can control the mode is the value of the inductor L (e.g. L1, L2, L3 or L4 respectively of FIGS. 3-6) As will be discussed in more detail below, for instance, the inductor L can be chosen to achieve a transition from discontinuous mode to continuous mode at approximately $0.7<D<0.8$.

For the power converter illustrated in FIGS. 3 and 4, the current drawn from the power source in discontinuous mode can be represented by the following equation:

$$I_{linkdisc} = \frac{V_{th} - V_{led}}{\frac{2L}{D^2T} + R_{th}}; \text{ wherein} \tag{6}$$

$I_{linkdisc}$ is the current drawn from the power source in discontinuous mode; and L is the value of the inductor in the power converter in FIG. 3 or FIG. 4.

The current drawn from the power source in continuous mode can be represented by the following equation:

$$I_{linkcont} = \frac{V_{th}}{R_{th}} - \frac{V_{led}}{DR_{th}}; \text{ wherein} \tag{7}$$

$I_{linkdisc}$ is the current drawn from the power source in continuous mode.

Figure 9:
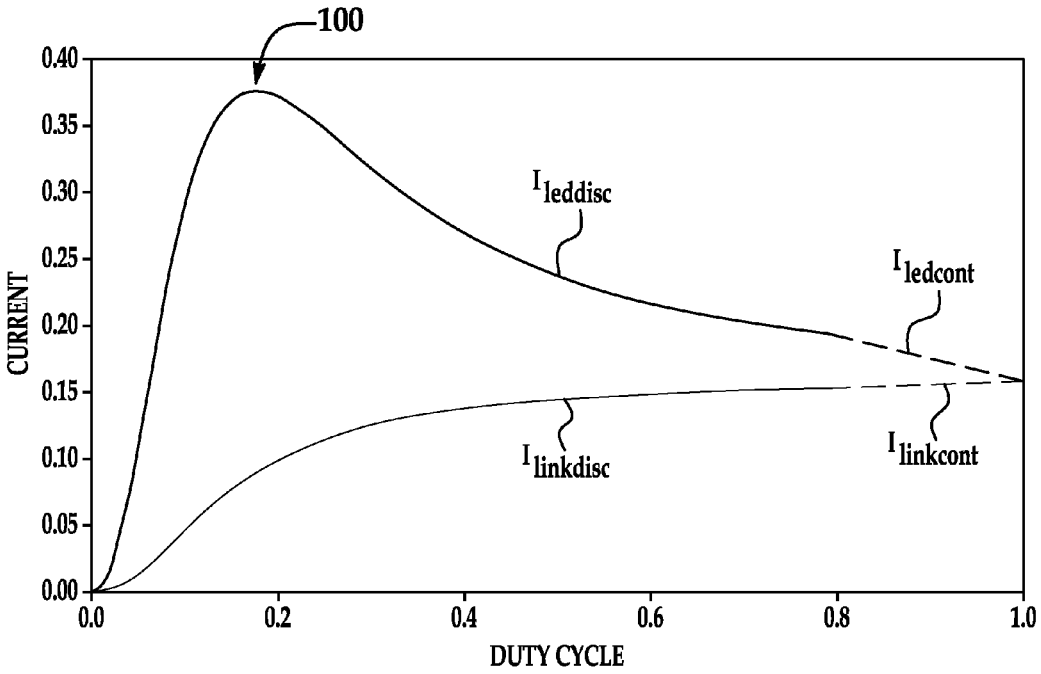
FIG. 9 is a plot of $I_{led}$ and $I_{link}$ vs. duty cycle when being driven by the circuit topology of FIG. 3 or 4.

As can be seen in FIG. 9, both equations (6) and (7) are monotonically increasing functions of D. Accordingly, the value of $I_{link}$ (or more specifically for each mode as shown in FIG. 9, $I_{linkdisc}$ or $I_{linkcont}$) can be controlled by controlling the value of the duty cycle D. Similarly, since $I_{led}$ (or more specifically for each mode as shown in FIG. 9, $I_{leddisc}$ or $I_{ledcont}$) $I_{led}$ can also be represented as a function of $I_{link}$ as set forth in equation (4), the value of $I_{led}$ can also be controlled by controlling the value of the duty cycle D.

From these equations, feedback circuit 26 can be configured such that the duty cycle D is greater than the duty cycle that results in the maximum value of as set forth in equation (5). The maximum value of $I_{led}$ is shown as point 100 in FIG. 9. After the peak at point 100, $I_{leddisc}$ and $I_{ledcont}$ (i.e. the average current through LED 20) will decrease as D increases.

Accordingly, feedback circuit 26 can be configured in FIG. 3 or 4 (or other power converter) to achieve the following:

1) a value of a duty cycle greater than the value needed to achieve the maximum value of $I_{led}$ (i.e. peak at point 100);

2) an increase in the duty cycle D decreases $I_{led}$ current; and 3) a decrease in the duty cycle D increases $I_{led}$ current.

As discussed previously and as shown in FIG. 9, the value of the inductor L can be chosen such that the transition from discontinuous mode to continuous mode is at approximately 0.7<D<0.8. Of course, other suitable points of transit are possible and can be based on factors in lieu of or in addition to the value of inductor L.

As discussed previously, this configuration is contrary to the ordinary function of known feedback circuits. In known feedback circuits, an increase in the duty cycle D can increase the current through the LED and a decrease in the duty cycle D can decrease the duty cycle D. Embodiments of the present invention can, at a minimum, invert this relationship.

Similar relationships as those discussed above also exist for the power converters illustrated in FIGS. 5 and 6. For example, analogous to equations (6) and (7), the $I_{link}$ current can be represented by the following relationships:

$$I_{linkdisc\,2} = \frac{V_{th}}{\frac{2L}{D^2T} + R_{th}} \tag{8}$$

$$I_{linkcont\,2} = \frac{V_{th} + V_{led}}{R_{th}} - \frac{V_{led}}{DR_{th}} \tag{9}$$

Figure 10:
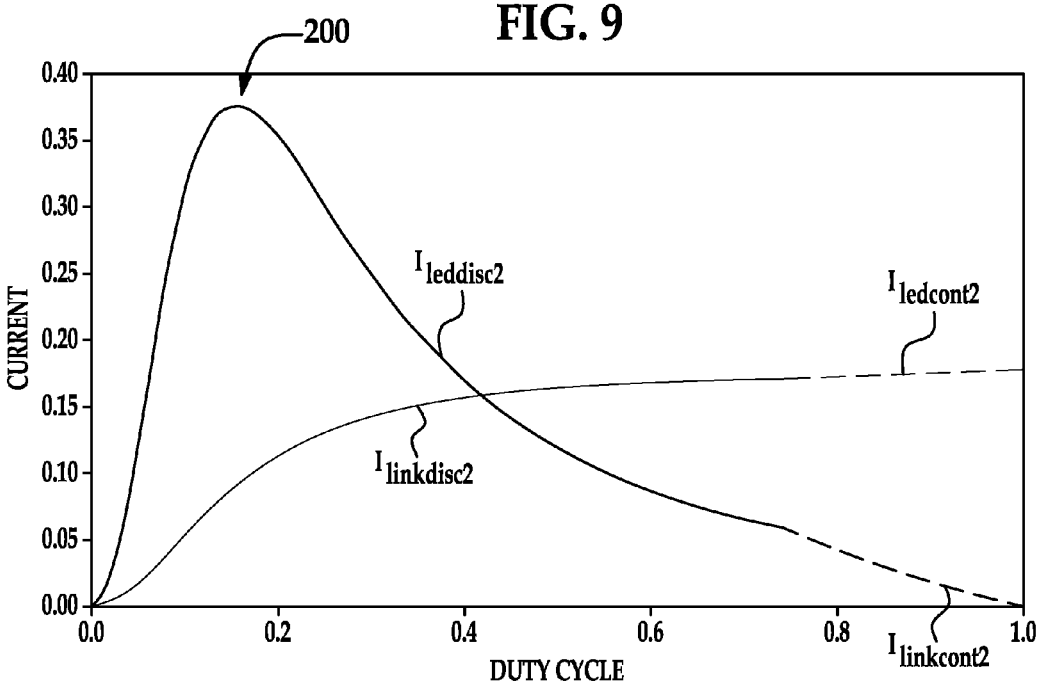
FIG. 10 is a plot of $I_{led}$ and $I_{link}$ vs. duty cycle when being driven by the circuit topology of FIG. 5 or 6.

As can be seen in FIG. 10 and similar to the $I_{link}$ equations discussed previously, both equations (8) and (9) are monotonically increasing functions of D. Accordingly, the values of $I_{linkdisc2}$ and $I_{linkcont2}$ an be controlled by controlling the value of the duty cycle D. Similarly, since $I_{led}$ (or more specifically for each mode as shown in FIG. 10, $I_{leddisc2}$ or $I_{ledcont2}$). As discussed previously, $I_{led}$ can be represented as a function of $I_{link}$ as set forth in equation (4) so that the value of $I_{led}$ can also be controlled by controlling the value of the duty cycle D. Accordingly, similar to that discussed above feedback circuit 26 can be configured in FIG. 5 or 6 (or other power converter) to achieve the following:

1) a value of a duty cycle greater than the value needed to achieve the maximum value of $I_{led}$ (i.e. peak at point 200);

2) an increase in the duty cycle D decreases $I_{led}$ current; and 3) a decrease in the duty cycle D increases $I_{led}$ current.

In addition, using the circuitry as taught herein, dimming of LED 20 can also be achieved by varying the duty cycle D.

Power converter or control circuits taught herein, such as circuits 18, 36, 62 or 72 can be used in conjunction with many applications to supply LED arrays. For example, circuits 18, 36, 62 or 72 can be used with LED arrays for communication with building controls and monitors. One use is to implement circuits 18, 36, 62 or 72 with powering, dimming and/or color control. Powering and/or dimming control can be accomplished by measuring a light level at the LED arrays or at a location remote from the LED arrays. Powering and/or dimming control can also be accomplished by using motion sensors in the LED arrays or at a location remote from the LED arrays. The motion sensors in the LED arrays may also include time delay logic. Color control can be accomplished through controlling LED array light color through ambient light sensors.

Circuits 18, 36, 62 or 72 can also be used with powering, dimming and/or color control that is controlled remotely or through the internet. Calendar-clock functions and LED array lighting circuitry can be used with circuits 18, 36, 62 or 72 so that individual and/or groups of lights can be programmed to power on or power off and dim at preset times.

Moreover, circuits 18, 36, 62 or 72 can be integrated with other applications to provide functions in addition to lighting of LED arrays. Some examples are (1) integrating circuits 18, 36, 62 or 72 with an HVAC control panel to allow one central control function to switch building functions into an "occupied" or "unoccupied" mode; (2) integrating circuits 18, 36, 62 or 72 with light controls to use in building alarms to improve burglar, smoke and fire alarm systems; (3) integrating circuits 18, 36, 62 or 72 with light controls and emergency power generators such that lights will detect when a building is on backup power and thus, switch into a reduced-power draw mode; (4) integrating circuits 18, 36, 62 or 72 with sound cards and small speakers in building lights, such that alarms, announcements, emergency broadcasts and background music can be wirelessly sent to sound-enabled lights, which can eliminate the need for separate building sound systems; (5) integrating circuits 18, 36, 62 or 72 with lights and emergency notifications, including telephone extensions, intrusion, robbery and fire alarms such that the lights in the notifying area flash in a distinctive pattern in order to guide emergency personnel to the event area. The notifying area may be at the same location as the event area or at a location separate from the event area.

Circuits 18, 36, 62 or 72 can also be used with controls that limit the amount of power used based on communication from a building's power supply monitoring, such that at times of peak building power use, the lights will automatically dim unless there is an authorized manual override. Moreover, circuits 18, 36, 62 or 72 can be used with LED arrays that self-diagnose and report lumen/wattage performance to a building controller/monitor so that the LEDs can be replaced when they become inefficient. Microphones can be integrated into the lighting circuitry for communication and remote sound monitoring functions Likewise, still image and video cameras can be integrated into the lighting circuitry for security and remote area monitoring.

According to one example as described above, a dimming function can be provided by a number of configurations incorporating embodiments according to the invention. Currently, dimming is easy and inexpensive to accomplish in incandescent systems. Most commonly, it is implemented using phase control dimmers.

Because of the operating characteristics of most fluorescent ballasts, however, phase control dimmers work poorly or not at all. Dimming fluorescent lighting requires special ballasts, and in many cases requires special dimming controls and specialized building wiring. These systems are more expensive to install than non-dimmable systems because of increased ballast, dimmer and wiring costs. Because of this, most fluorescent installations are not dimmable.

Embodiments of the invention can add dimming functionality to a fluorescent lighting system when replacing the conventional fluorescent lamp with an LED-based replacement as previously described. These embodiments provide several advantages over current dimming technology, including a retrofit of dimmable LED lamps to non-dimmable fluorescent systems, no-tool installation of the hand-held remote implementation and dimmable operability with or without existing ballasts.

Figure 11:
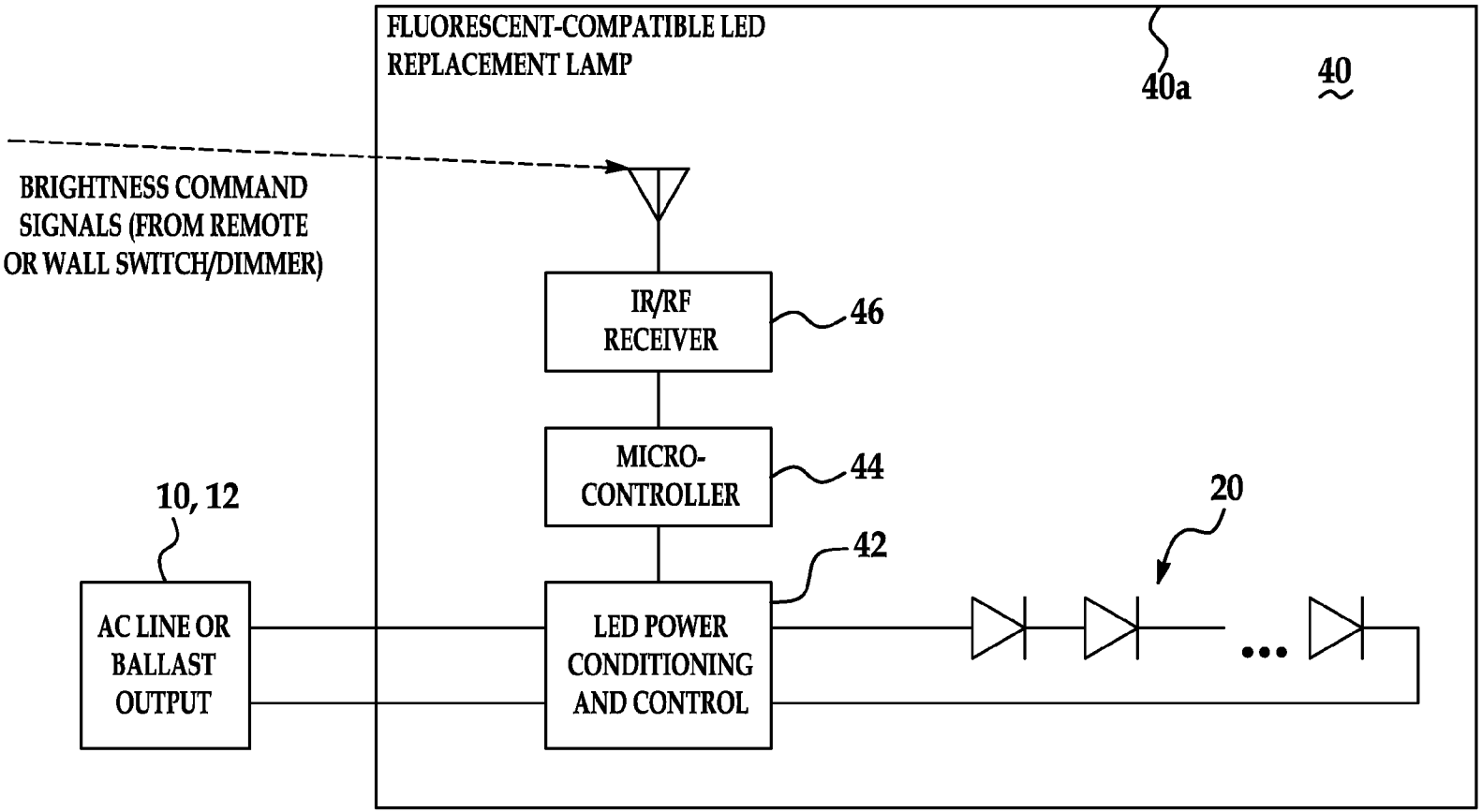
FIG. 11 is a partial schematic view of one embodiment of a dimmable LED lamp in which embodiments of the invention can be incorporated.
Figure 12:
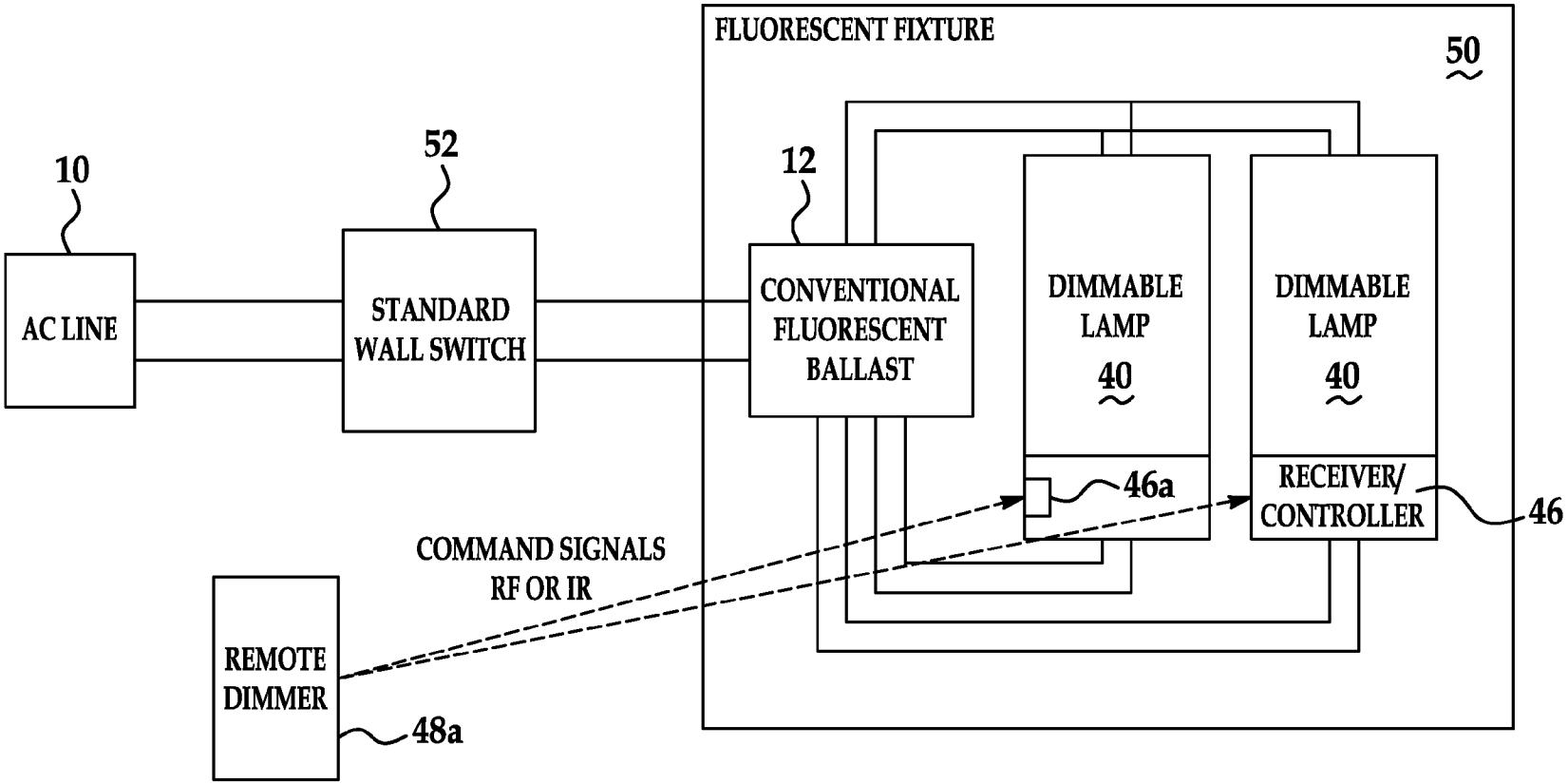
FIG. 12 is a partial schematic view of one embodiment of a fluorescent fixture incorporating a dimmable LED lamp according to FIG. 12.
Figure 13:
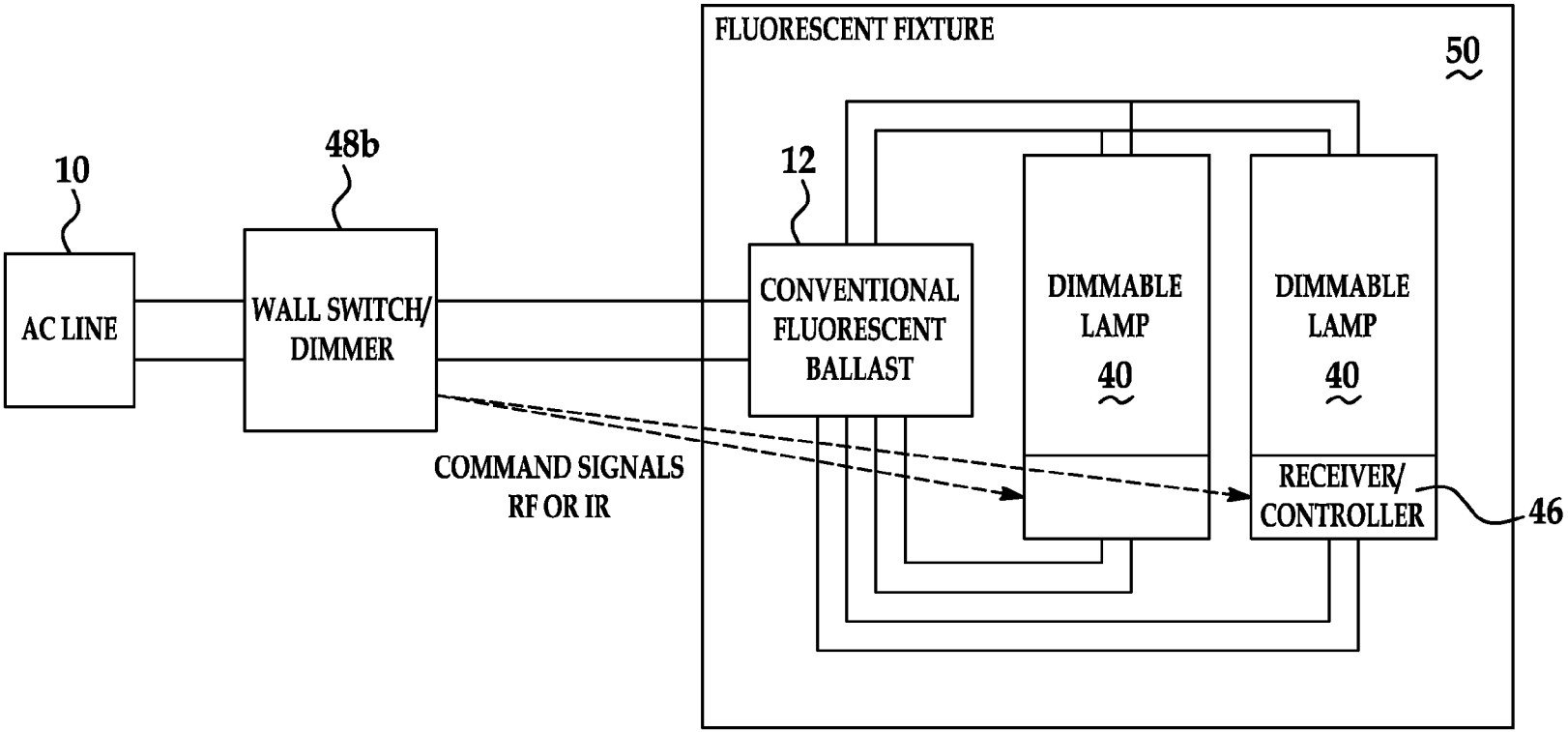
FIG. 13 is a partial schematic view of another embodiment of a fluorescent fixture incorporating a dimmable LED lamp according to FIG. 12.

FIGS. 11-13 show examples of a LED lamp 40 for fluorescent lamp replacement with integral remote dimming control. LED lamp 40 is connected to ballast 12 or AC line input 10. The LED light source, here LED 20, is coupled to a LED power conditioning and control circuit 42, which can be, for example, either of circuits 18 or 36 or their equivalent. The dimming circuit is implemented in FIG. 11 by a microcontroller 44, discussed in additional detail hereinafter. LED lamp 40 also includes an infrared (IR) or radio (RF) remote control signal receiver 46 including an antenna.

As shown in FIGS. 12 and 13, a remote dimmer may be a handheld remote 48*a* similar to a TV remote, or may be a replacement for a wall switch 48*b*, which transmits a signal that is related to the desired brightness level. The signal is received by the remote control receiver 46 in the LED lamp 40, is decoded and is used to control the power level of LED 20. In the embodiment shown, the decoding and control circuit uses a microprocessor such as microcontroller 44, but analog and non-microprocessor digital implementations are also possible.

Microcontroller 44 is shown as a separate device providing a control signal to LED power conditioning and control circuit 42 in FIG. 11, specifically to control system 28 of feedback circuit 26. However, the functions of microcontroller 44, namely receiving a signal from receiver 46, decoding that signal and transmitting a signal controlling the power level of LED 20, can be implemented with control system 28.

In the IR remote implementation, IR receiver 46 is placed within LED lamp 40, with an IR sensor 46*a* pointing out through the portion of a housing 40*a* used to emit light from LED 20. If LED lamp 40 emits light from more than one surface of housing 40*a*, such as from two sides of a circuit board upon which LED 20 is mounted, in order to receive IR remote signals from all sides, the implementation may use multiple IR sensors to ensure a clear view of the signal from remote 48*a*.

LED 20 preferably comprises white LEDs. Since white LEDs have relatively little IR output, interference between illumination LED 20 and the IR link should be minimal. However, to minimize the chances of interference, the IR control frequency should not be near the PWM dimming control frequency.

The RF remote implementation can use any of a wide variety of RF remote technologies. Where LED lamp 40 is a replacement for a fluorescent light tube, for example, any required antenna can be incorporated integrally with the circuit board for the controller 42, 44 and LED 20 because the LED lamp 40 is long. Such a replacement is shown by example in U.S. Pat. No. 7,049,761, which is incorporated herein in its entirety by reference.

As shown in FIGS. 12 and 13, multiple dimmable LED lamps 40 can be incorporated into a single fluorescent fixture 50. Fixture 50 is turned on and off by a standard wall switch 52 or the combined wall switch/dimmer 48*b*, thus providing power to conventional fluorescent ballast 12 and the remainder of the control circuitry. One remote dimmer, either from the handheld remote 48*a* or from one 48*b* integrated with a wall switch, can be used to control each LED lamp 40.

Alternatively, since lamp power controller 44 is modulating the LED output, it is possible to make the modulation of the visible light from lamp 40 contain control information to be received and acted on by other lamps 40. In that way, all the lights in a room can be controlled by pointing the remote at one lamp 40. That lamp 40 could in turn transmit the control information to yet other lamps 40. Individual lamps 40 could be addressed using digital coding as is known in the art.

Further, one or more infrared emitting diodes either separate from or incorporated in LED 20 could be used to relay commands from one lamp 40 to others in the area.

Currently, most white LEDs frequently have an undesirable color shift when operated at DC currents less than the design point of the LED. Accordingly, dimming is provided in one embodiment through on-off switching of LED 20 at a frequency above that which will be perceived by the viewer's eye. The perceived brightness will increase with increased duty cycle of the LED, while the color remains constant since when the LED is on, it is on at full brightness.

When the lamp is fitted with LED 20 designed to have a desirable color shift during operation at various DC currents, control can alternatively be implemented by regulating a substantially DC current at various levels to provide dimming.

It is preferred in certain embodiments incorporating a microcontroller 44 or other microprocessor that the desired dimming level be stored in a non-volatile manner so that if power to the LED lamp 40 or fixture 50 is turned off at wall switch 52, 48*b*, the desired dimming level is restored once power is restored. Optionally, the system may restore the brightness to full if AC power is cycled, or if a specified sequence of power is applied.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An illumination device having at least one LED and a power converter with a switching element for connection to an existing fluorescent lamp fixture including a ballast, the illumination device comprising:

a feedback circuit operable to provide a switching signal to the switching element according to a duty cycle, the feedback circuit configured to:

increase the value of the duty cycle to decrease an output current signal through the at least one LED; and decrease the value of the duty cycle to increase the output current signal through the at least one LED.

2. The device of claim 1, wherein feedback circuit is further configured to output a value of the duty cycle greater than a predetermined value, the predetermined value representative of the duty cycle adapted to attain a maximum value of current through the at least LED.

3. The device of claim 2, wherein the predetermined value is greater than 0.2.

4. The device of claim 1, wherein the feedback circuit is further configured to determine an average current across the at least one LED and to invert a signal representing the average current to provide the switching signal to the switching element such that, for a range of operating points, increasing a current drawn into the power converter will decrease LED power and decreasing the current drawn into the power converter will increase LED power.

5. The device of claim 4, wherein the feedback circuit is configured to calculate the average current from the peak current obtained from at least one of a sense resistor and the emitted light output.

6. The device of claim 1, wherein the illumination device includes an alternating current input, a full-wave rectifier coupled to the alternating current input and configured to produce a rectified voltage output, wherein the switching element is electrically coupled to the rectified voltage output of the full-wave rectifier.

7. The device of claim 6, wherein the alternating current input comprises a ballast for a fluorescent bulb.

8. The device of claim 7, further comprising:

protection circuitry electrically coupled between the ballast and the full-wave rectifier.

9. The device of claim 6, wherein the at least one LED is coupled to the rectified voltage output of the full-wave rectifier and the switching element is a low-side switch electrically coupled between the at least one LED and a sense resistor.

10. The device of claim 9, further comprising:

an inductor in series with the at least one LED and located between the at least one LED and a connection point of the low-side switch and the at least one LED.

11. The device of claim 10, further comprising:

a diode in series with the inductor and the at least one LED and electrically coupled to the rectified voltage output, a diode located between the connection point and the rectified voltage output.

12. The device of claim 6, wherein the feedback circuit comprises a pulse width modulator and a control system for the pulse width modulator, the control system including an input coupled to the rectified voltage output and a second input coupled to a sense resistor.

13. The device of claim 6, wherein the switching element is a high-side switch connected between the rectified output voltage and the at least one LED.

14. The device of claim 13, further comprising:

an inductor connected in series with the at least one LED at a connection point between the at least one LED and the high-side switch; and wherein a sense resistor is connected in series with the inductor and the at least one LED and is coupled to ground.

15. The device of claim 14, further comprising:

a diode connected to a connection point between the high-side switch and the inductor such that the diode is reverse-biased when the high-side switch is closed; and wherein the recirculation diode is in parallel with the at least one LED.

16. The device of claim 14, wherein the feedback circuit comprises a pulse width modulator and a control system for the pulse width modulator, the control system including a first input coupled to the rectified voltage output and a second input coupled to a sense resistor.

17. The device of claim 1, further comprising:

a remote signal receiver configured to receive a remote signal indicating a desired brightness level for the at least one LED; and a dimming circuit responsive to the remote signal receiver and configured to provide a control signal to the feedback circuit indicating the desired brightness level.

18. The device of claim 17, wherein the remote signal receiver comprises one of an infrared receiver and a radio frequency antenna.

19. The device of claim 1, wherein feedback circuit is configured to output a duty cycle with a value greater than the duty cycle used to achieve a maximum value of current through the at least one LED.

20. A method of controlling a feedback circuit for an illumination device having at least one LED and a power converter with a switching element, comprising:

providing a switching signal to the switching element according to a duty cycle; and at least one of:

increasing the value of the duty cycle to decrease an output current signal through the at least one LED; or decreasing the value of the duty cycle to increase the output current signal through the at least one LED.

* * * * *